US010975572B2

(12) United States Patent
Park

(10) Patent No.: US 10,975,572 B2
(45) Date of Patent: Apr. 13, 2021

(54) V-SHAPED TIE HOOP ASSEMBLY

(71) Applicant: Seong Wook Park, Seoul (KR)

(72) Inventor: Seong Wook Park, Seoul (KR)

( * ) Notice: Subject to any disclaimer, the term of this patent is extended or adjusted under 35 U.S.C. 154(b) by 0 days.

(21) Appl. No.: 16/819,691

(22) Filed: Mar. 16, 2020

(65) Prior Publication Data

US 2020/0291654 A1 Sep. 17, 2020

(30) Foreign Application Priority Data

Mar. 14, 2019 (KR) ..... 10-2019-0029531
May 29, 2019 (KR) ..... 10-2019-0063044

(51) Int. Cl.
*E04C 5/16* (2006.01)
*E04C 5/06* (2006.01)

(52) U.S. Cl.
CPC ..... *E04C 5/166* (2013.01); *E04C 5/06* (2013.01); *E04C 5/162* (2013.01)

(58) Field of Classification Search
CPC ..... E04C 5/167; E04C 5/162; E04C 5/166; E04C 5/06; E04C 5/03; E04C 5/0604; E04C 5/0622
USPC ..... 52/677, 688
See application file for complete search history.

(56) References Cited

U.S. PATENT DOCUMENTS 1,457,610 A * 6/1923 White ..... E04C 5/18 52/688
3,289,378 A * 12/1966 Carroll ..... E04C 5/18 52/688
4,249,354 A * 2/1981 Wynn ..... E04B 2/8629 52/309.12
4,463,538 A * 8/1984 Dragunas ..... E04C 5/0604 52/677
6,637,171 B1 * 10/2003 Toone ..... E04C 5/167 248/156
10,017,942 B2 * 7/2018 McCarthy ..... E04C 5/06
2012/0137618 A1 * 6/2012 Martter ..... E04C 5/0645 52/649.1
2012/0137619 A1 * 6/2012 Martter ..... E04C 5/0645 52/649.1

FOREIGN PATENT DOCUMENTS

KR 10-1913818 B1 10/2018
WO WO-2015147415 A1 * 10/2015 ..... E04C 5/0604
WO WO-2019093540 A1 * 5/2019 ..... E04C 5/06
WO WO-2019093541 A1 * 5/2019 ..... E04C 5/04

* cited by examiner

*Primary Examiner* — Adriana Figueroa
(74) *Attorney, Agent, or Firm* — Novick, Kim & Lee, PLLC; Jae Yoon Kim

(57) ABSTRACT

A V-shaped tie hoop assembly enhances field construction performance by integrally forming a plurality of V-shaped tie hoops after constituting the plurality of V-shaped tie hoops in a bundle form, maintains intervals, and enhances reinforcement performance. The V-shaped tie hoop assembly can includes: a plurality of V-shaped tie hoops, each of which has a bending part at the center thereof and anchor parts extending to opposite sides of the bending part, and disposed at different heights at an interval; and a vertical support bar connecting all of the V-shaped tie hoops to integrally couple the V-shaped tie hoops.

3 Claims, 12 Drawing Sheets

V-SHAPED TIE HOOP ASSEMBLY

BACKGROUND OF THE INVENTION

1. Field of the Invention

The present invention relates to a V-shaped tie hoop assembly, and more particularly, to a V-shaped tie hoop assembly that enhances field construction performance by integrally forming a plurality of V-shaped tie hoops after constituting the plurality of V-shaped tie hoops in a bundle form, maintains intervals, and enhances reinforcement performance.

2. Description of the Prior Art

A tie hoop is a rebar or a steel hoop that surrounds a main reinforcement, and refers to a rebar or a steel wire that is continuously wound in a circular, rectangular, or a polygonal shape, and reinforces the vertical main reinforcement of a concrete column and prevents buckling (a phenomenon of deflecting horizontally at a limit point of a vertical stress generated in a column structure).

Further, although the tip hoops are generally disposed to surround all the vertical rebars, auxiliary tie hoops of various shapes are added in the interiors of the tie hoops when the disposition interval of the vertical rebars is large or the column has a large number of main reinforcements. A existing auxiliary tie hoop is called as a cross tie and has a bending angle of 90 degrees at one end and a bending angle of 135 degrees at an opposite end thereof, and main reinforcements are installed on opposite sides of the auxiliary tie hoop, whereby bucking of the main reinforcements is prevented and thus a transverse restraint effect of a compressive material is enhanced.

In particular, a V-shaped (or U-shaped) tie hoop replaces the function of the existing cross tie (auxiliary tie hoop), and is a configuration of supplementing an installation disadvantage of the existing cross tie and the disadvantage by which a 90 degree hook portion is released by repeated transverse forces after installation.

The V-shaped tie hoops is individually installed one by one, and thus it is necessary to improve a structure capable of prolonging work time and enhancing construction performance.

As a prior technology related to a conventional V-shaped tie hoop, Korean Patent No. 10-1913818 (entitled 'Column Reinforcing Structure Using V-shaped Tie Hoop for Vibration-resistant Design and Method for Constructing the Same') discloses a technology including: an existing column in which rebars are arranged in the interior of concrete; a plurality of main reinforcements arranged vertically outside the existing column; a reinforcing tie hoop arranged to surround the outsides of the plurality of main reinforcements; a V-shaped tie hoop having extending/fixing parts having a V shape and bent upwards and downwards and attached to an outer peripheral surface of the existing column at an end of the fixing part on opposite sides of a bending part, in which an inside of the bending part is attached to an outside of the main reinforcement, and in which the fixing part is coupled to the main reinforcement to face the existing column; and retrofitting concrete installed outside the existing column such that the main reinforcement and the V-shaped tie hoop are buried therein.

However, the prior technology is a technology for arranging reinforcing tie hoops and V-shaped tie hoops together with a main reinforcement outside an existing column when the column is reinforced through retrofitting of concrete.

SUMMARY OF THE INVENTION

The present invention has been made in an effort to solve the above-described problems, and provides a V-shaped tie hoop assembly that includes an assembly in which a plurality of V-shaped tie hoops are coupled to each other in a bundle form as the V-shaped tie hoops are taken as one medium, thereby remarkably enhancing field construction performance, increasing a reinforcement effect by effectively maintaining the intervals between the V-shaped tip hoops, and thus minimizing deformation due to an impact in a concrete installing process.

The present invention includes: a plurality of V-shaped tie hoops, each of which has a bending part at the center thereof and anchor parts extending to opposite sides of the bending part, and disposed at different heights at an interval; and a vertical support bar connecting all of the V-shaped tie hoops to integrally couple the V-shaped tie hoops The support bar may be coupled to the outsides of the bending parts of the V-shaped tie hoops, and Further, the support bar further includes an inverse U-shaped hook part.

Further, the V-shaped tie hoop assembly may further include fixing clips coupled to the V-shaped tie hoops to increase coupling forces with the main reinforcement located inside the bending parts.

Further, each of the fixing clip may include: an arc-shaped support part bent in an arc shape such that the anchor parts of the V-shaped tie hoops are seated on opposite sides of the inner side thereof; an insertion guide part formed at a lower portion of the arc-shaped support part to be widened such that the V-shaped tie hoop is inserted, and having a width that is smaller than the interval of the arc-shaped support parts; and an elastic operation part formed at the center of an upper portion of the arc-shaped support part to be bent so as to be elastically deformed to opposite sides.

According to the present invention, because several V-shaped tie hoops can be installed in one main reinforcement at the same time by providing an assembly in which V-shaped tie hoops are integrally coupled to a support bar in a bundle form, construction performance can be remarkably increased as compared with a conventional technology of individually installed V-shaped tie hoops.

Further, according to the present invention, because the intervals between the V-shaped tie hoops can be effectively maintained and a reinforcement effect can be increased, deformation by an impact can be minimized in a concrete installing process.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE EXEMPLARY EMBODIMENTS

Hereinafter, preferred embodiments of the present invention will be described in detail with reference to the accompanying drawings. A detailed description of known technologies related to the present invention will be omitted to avoid making the technical essence of the present invention rather unclear.

Because the conventional tie hoops is individually coupled to the main reinforcement, operation time is long and construction efficiency is very low, and the present invention is made to solve the problems through a V-shaped tie hoop assembly.

Figure 1:
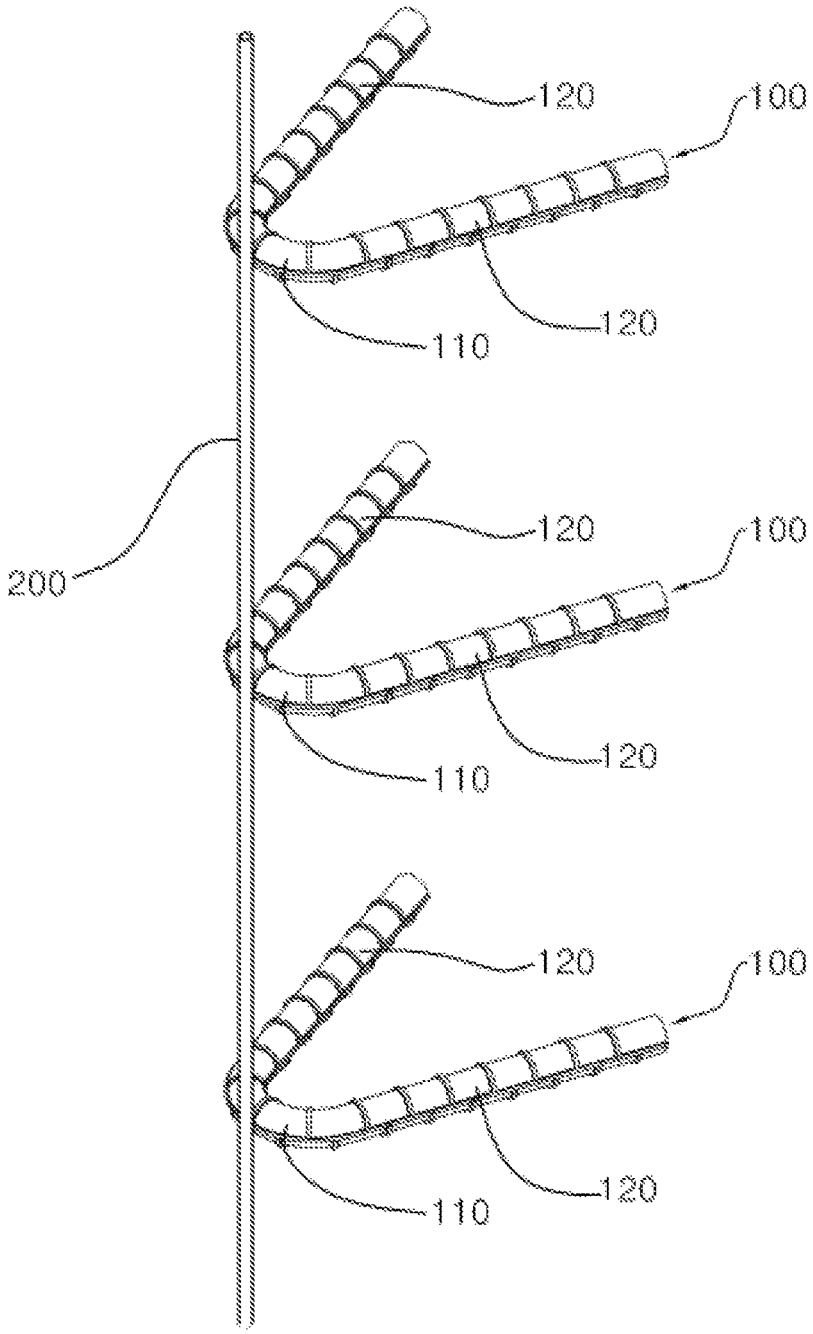
FIG. 1 is a perspective view illustrating a V-shaped tie hoop assembly according to the present invention.

The V-shaped tie hoop assembly according to the present invention, as illustrated in FIG. 1, a plurality of V-shaped tie hoops 100, each of which has a bending part 110 at the center thereof and anchor parts 120 extending to opposite sides of the bending part 110, and disposed at different heights at an interval, and a vertical support bar 200 connecting all of the V-shaped tie hoops 100 to integrally couple the V-shaped tie hoops.

Figure 2:
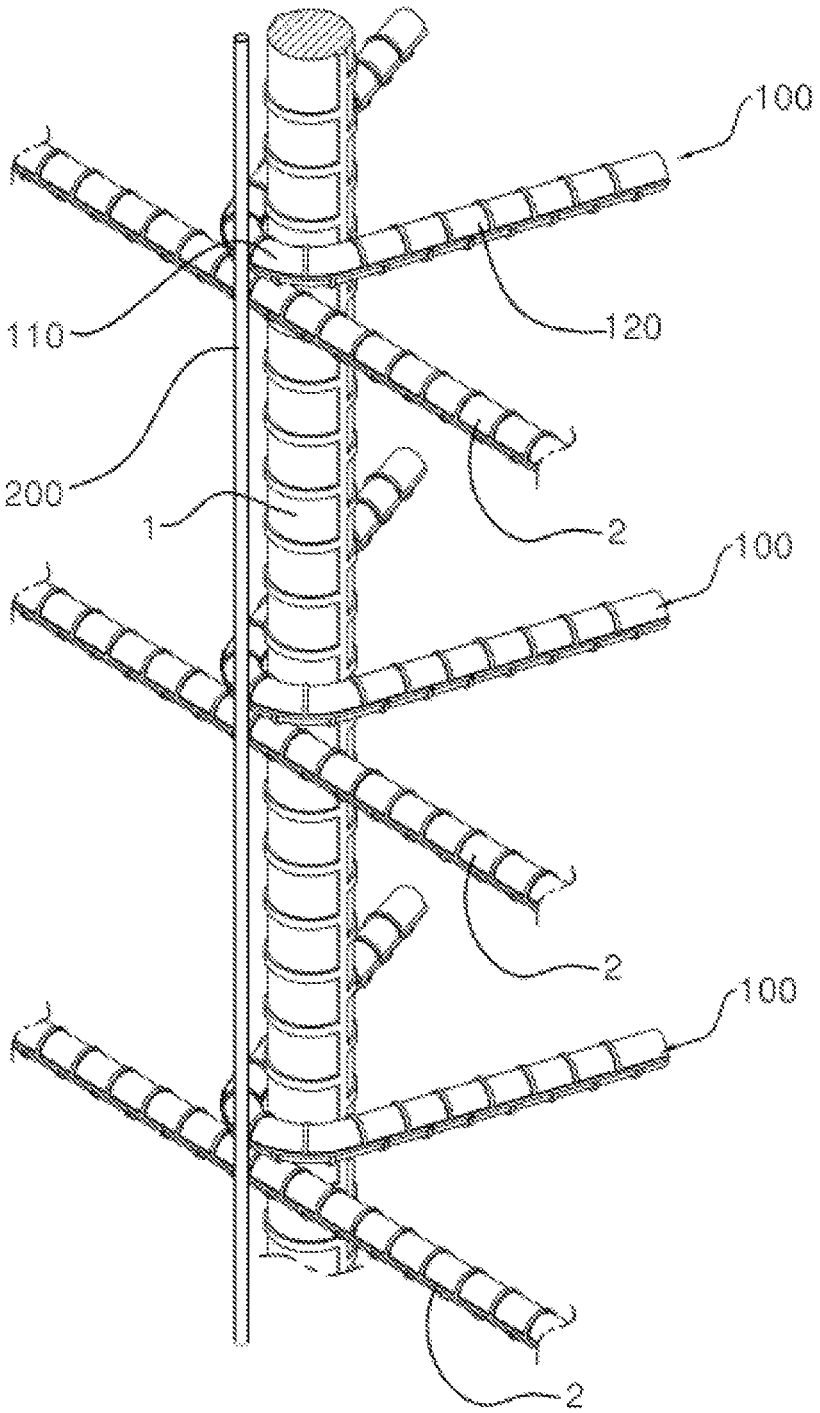
FIG. 2 is a perspective view illustrating an example in which the V-shaped tie hoop assembly is coupled to a main reinforcement and a hoop reinforcement according to the present invention.
Figure 3:
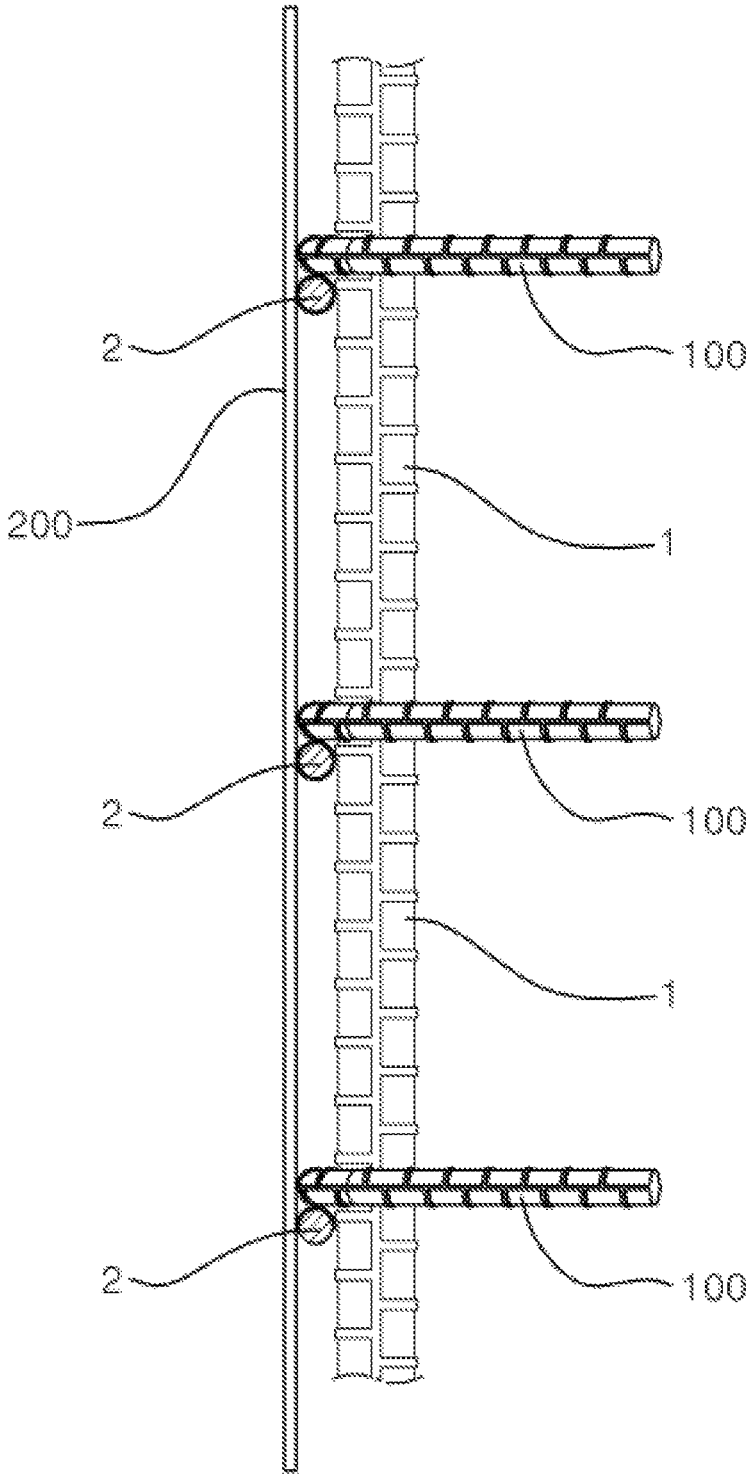
FIG. 3 is a side view illustrating an example in which the V-shaped tie hoop assembly is coupled to the main reinforcement and the hoop reinforcement according to the present invention.
Figure 4A:
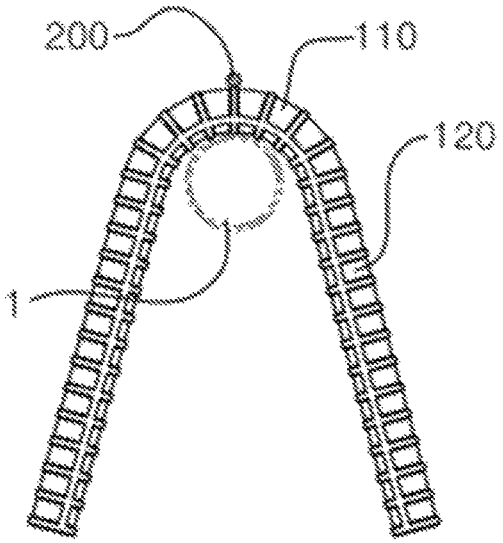
FIGS. 4(A)-4(D) are views illustrating embodiments according to the shapes of V-shaped hoops and the number of support bars in the forms of (A), (B), (C), and (D) according to the present invention.
Figure 4B:
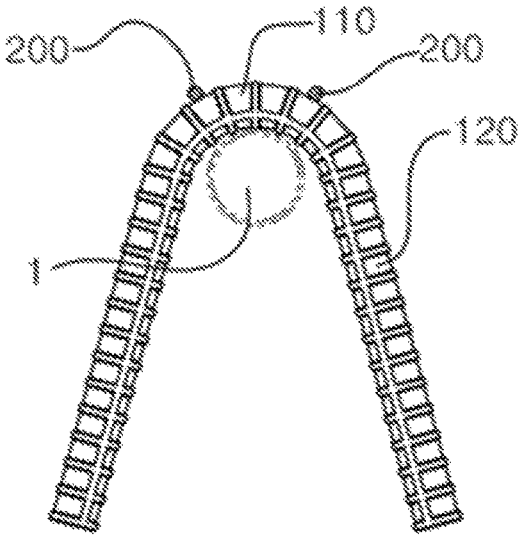
Figure 4C:
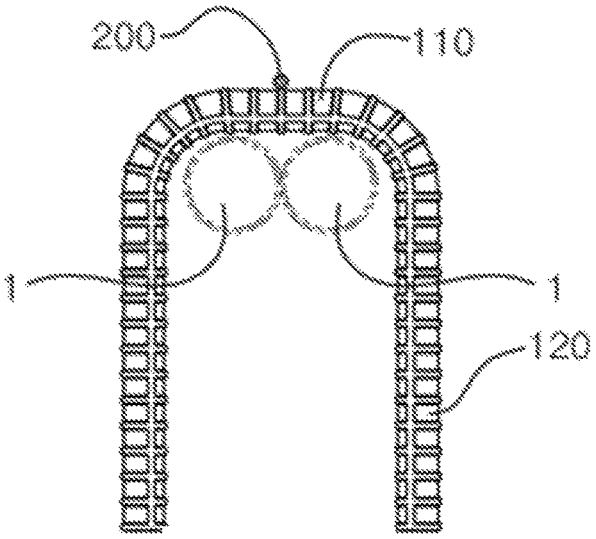
Figure 4D:
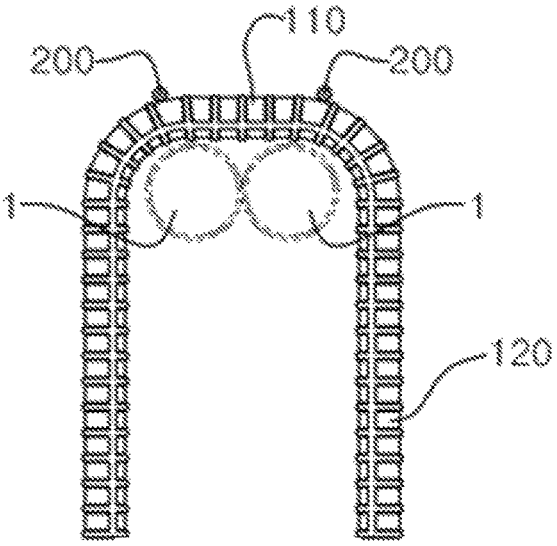

The present invention, as illustrated in FIG. 2, is a technology that is applied to sites at which a vertical main reinforcement 1 and a hoop reinforcement 2 that surrounds an outer circumference of the main reinforcement 1 for the purpose of an auxiliary tie hoop. That is, according to the present invention, because the plurality of V-shaped tie hoops 100 are integrally coupled to the support bar 200 formed vertically, several V-shaped tie hoops 100 may be installed in one main reinforcement 1 at the same time as illustrated in FIG. 2 or FIG. 3, and thus construction performance can be remarkably increased as compared with the conventional technology.

Various materials may be applied to the support bar 200 as a medium for connecting the V-shaped tie hoops 100, but it is preferable that the support part 200 is formed of a metallic material in consideration of a coupling force between the elements and the durability. Further, a method for integrally coupling the V-shaped tie hoops to the support bar 200 may be performed by a separate coupling unit (not illustrated), and may be performed through a bonding scheme such as welding. if the coupling unit is configured to move inside the support bar 200, the locations of the V-shaped tie hoops 100 may be immediately adjusted in the field to be used.

Further, the support bar 200 has to be coupled to the outsides of the bending parts 110 of the V-shaped tie hoops 100. This is because an interference problem occurs when the main reinforcement 1 and the hoop reinforcement 2 are coupled to each other and thus construction quality may be deteriorate when the support bar 200 is coupled to the inside of the bending parts 110.

Further, it is preferable that three or six V-shaped tie hoops 100 are coupled to the support bar 200, but of course, the number of the V-shaped tie hoops 100 may be more than six, and the fixing intervals of the V-shaped tie hoops 100 also may be not only equal but also unequal.

FIGS. 4(A)-4(D) illustrates an embodiment according the shapes of the V-shaped tie hoops 100 and the number of the support bars 200 of the present invention, and the shapes of the V-shaped tie hoops 100 is not limited and may be freely modified to various forms. Further, a plurality of support bars 200 are provided, a firmer coupling structure may be achieved.

Figure 5:
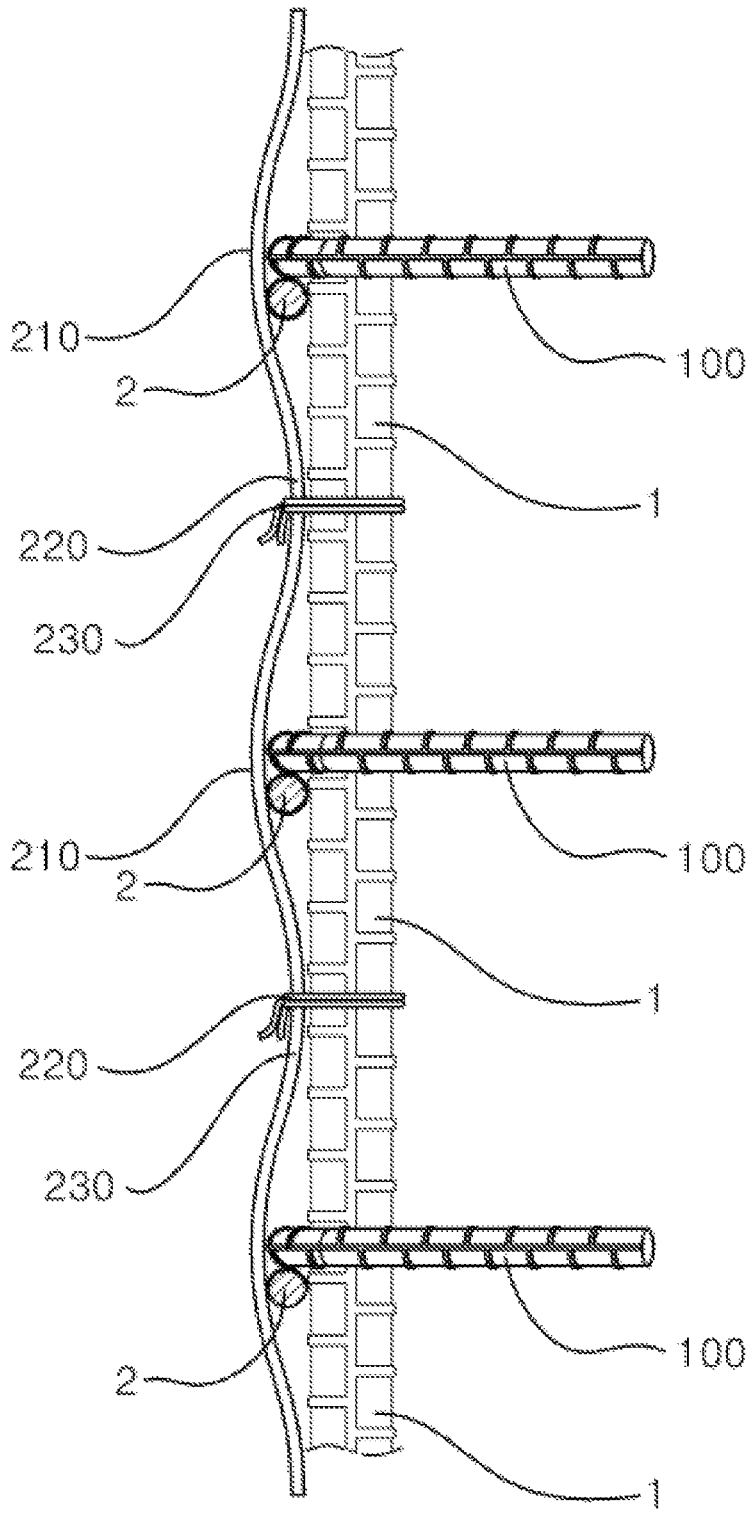
FIG. 5 is a view illustrating an embodiment in which a support bar has a waveform structure according to the present invention.

In the support part 200 of the present invention, as illustrated in FIG. 5, outwardly curved portions 210 and inwardly curved portions 220 may be repeatedly formed like a waveform structure. In this configuration, as illustrated in the drawings, the V-shaped tie hoops may be coupled to the outwardly curved portions 210 to be stably attached to the hoop reinforcement 2, and the inwardly curved portions 220 may be attached to the main reinforcement 1. Then, the inwardly curved portions 220 may be additionally fixed through a fastening wire 230 if necessary, such that a coupling forced can be further increased.

Figure 6:
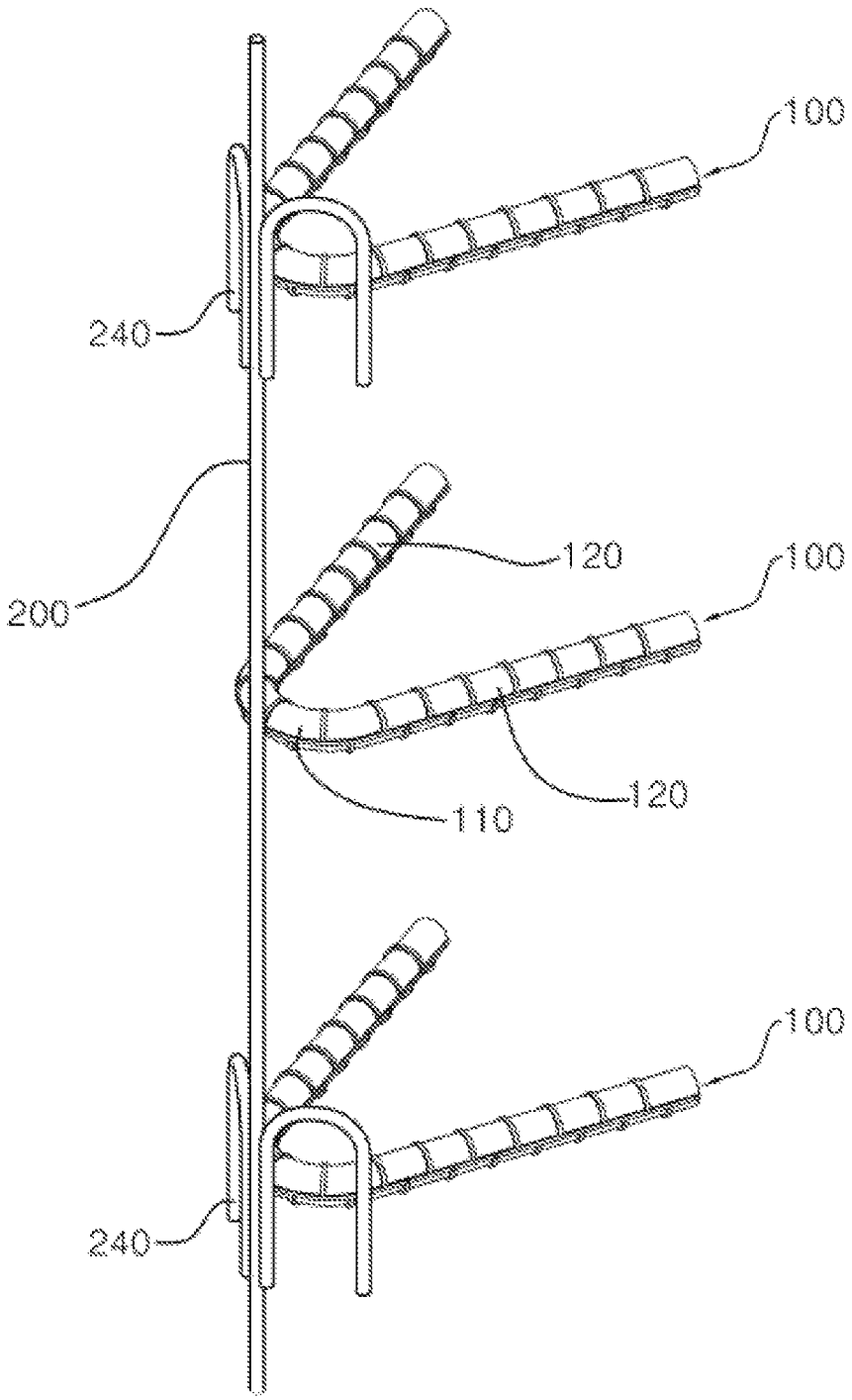
FIG. 6 is a view illustrating another embodiment in which an inverse U-shaped hoop part is further formed in the support bar.
Figure 7:
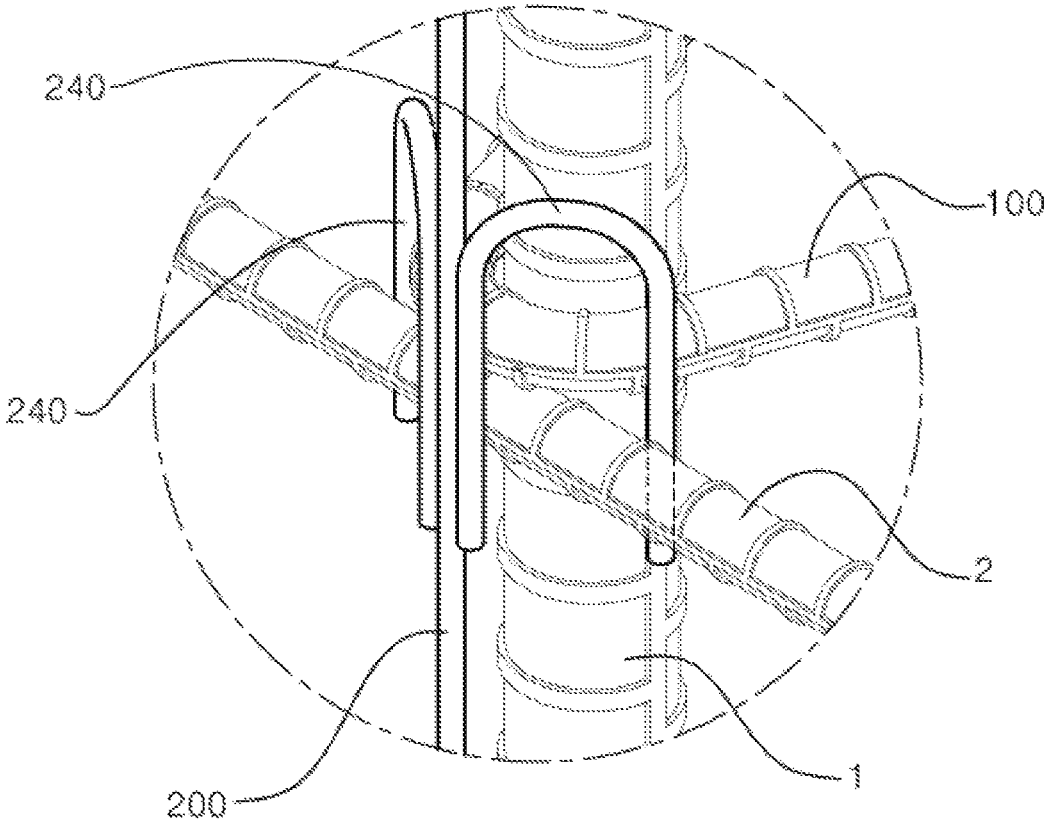
FIG. 7 is an enlarged perspective view illustrating a state in which the hoop part is held on the hoop reinforcement in the embodiment of FIG. 6.

FIG. 6 illustrates another embodiment in which an inverse U-shaped hoop part 240 is further formed in the support bar 200 of the present invention, in which the hoop part 240 is formed at a location that is adjacent to a portion thereof, to which the V-shaped tie hoop 100 is coupled, and may be stably held on at an upper portion of the hoop reinforcement 2 to increase construction convenience and may function as a handle in a construction process as a finger may be inserted into the hoop part 240. Further, because the hoop part 240 supports the inner and outer sides of the hoop reinforcement 2, rotation of the V-shaped tie hoops 100 can be prevented. The hoop part 240 may be formed at one point, but it is preferable that it is formed at upper and lower points to obtain a stable holding effect.

Figure 8:
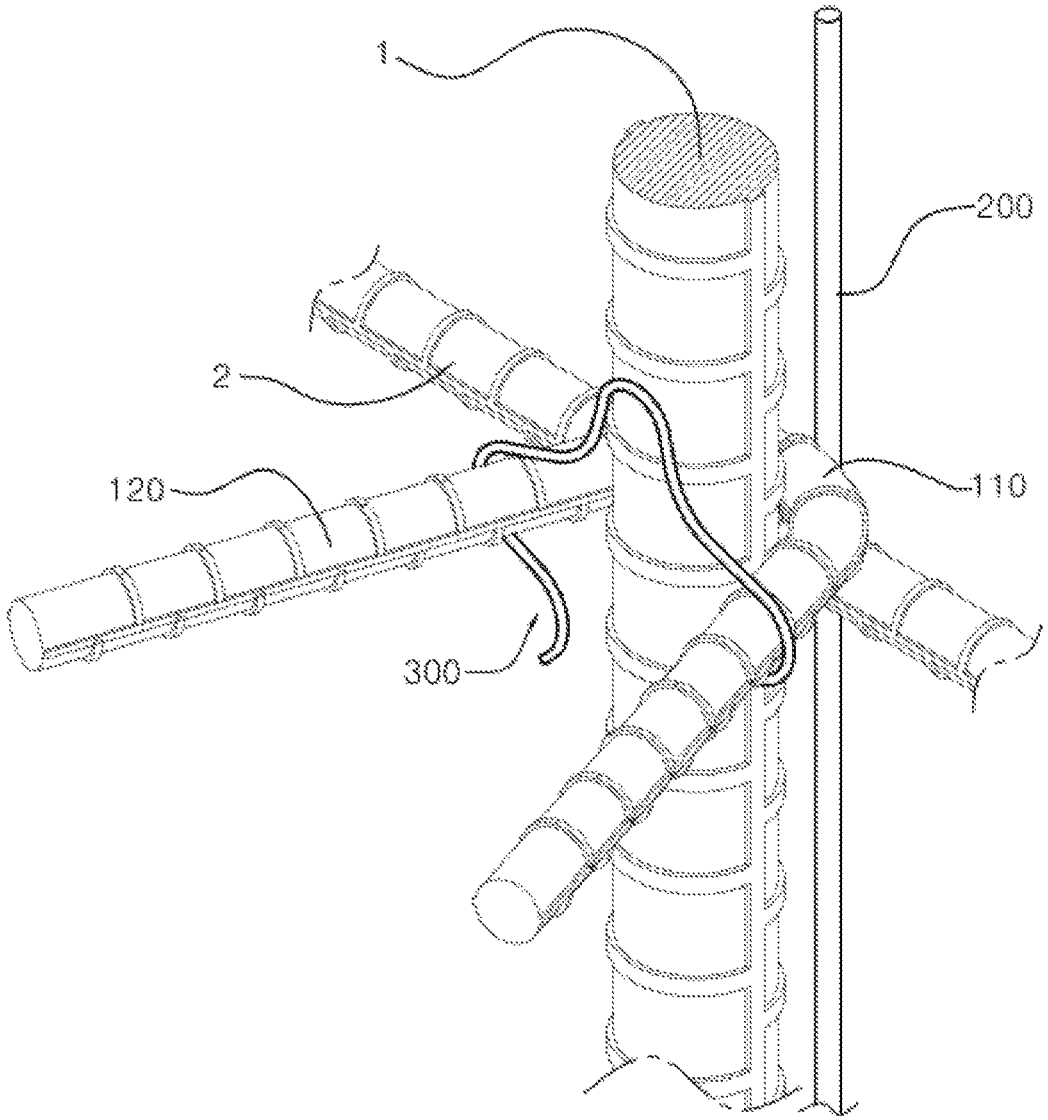
FIGS. 8 and 9 is a view illustrating a fixing clip is further coupled to the V-shaped tie hoop according to the present invention.
Figure 9:
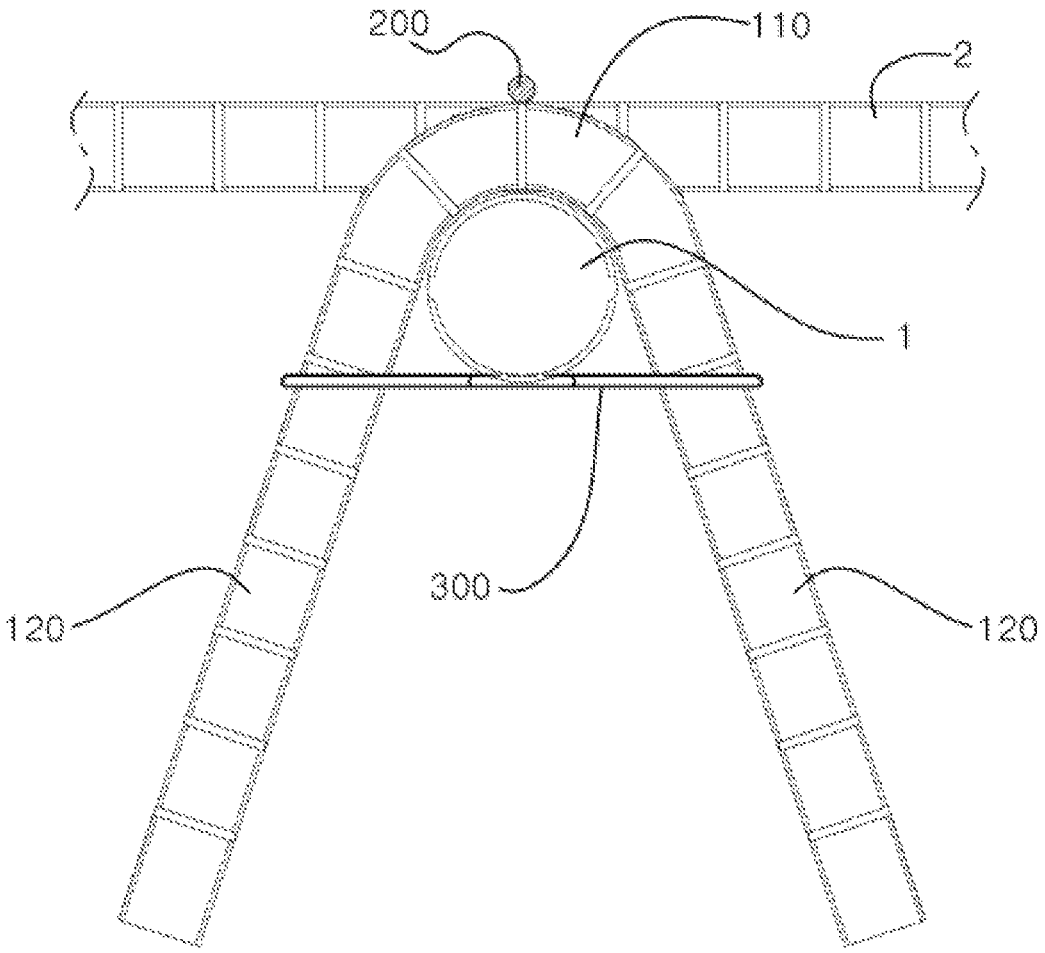

The present invention, as illustrated in FIGS. 8 and 9, may further include a fixing clip 300 that is coupled to the V-shaped tie hoop 100 to increase a coupling force with the main reinforcement 1 located inside the bending part 110. The fixing clip 300, as illustrated in FIG. 8, is a configuration that is coupled to a side that is opposite to a portion of the V-shaped tie hoop 100, which is surrounded by the bending part 110, with respect to the main reinforcement 1, and prevents the V-shaped hoop 100 from deviating to the outside.

Figure 10:
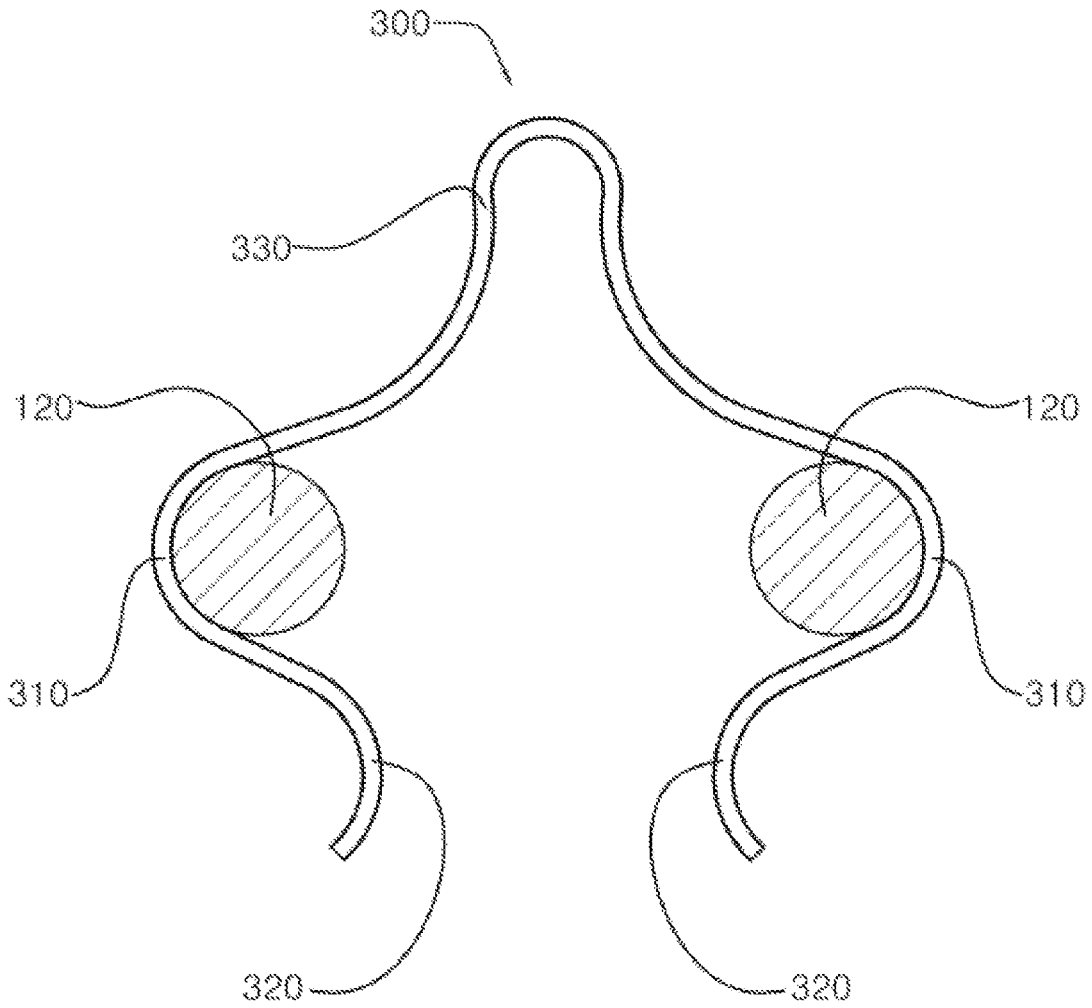
FIG. 10 is a view illustrating configurations of the fixing clip according to the present invention.

The configuration of the fixing clip 300, as illustrated in FIG. 10, includes: an arc-shaped support part 310 bent in an arc shape such that the anchor parts 120 of the V-shaped tie hoops 100 are seated on opposite sides of the inner side thereof; an insertion guide part 320 formed at a lower portion of the arc-shaped support part 310 to be widened such that the V-shaped tie hoop 100 is inserted, and having a width that is smaller than the interval of the arc-shaped support parts 310; and an elastic operation part 330 formed at the center of an upper portion of the arc-shaped support part 310 to be bent so as to be elastically deformed to opposite sides.

The arc-shaped support part 310 is a configuration of supporting the outsides of the opposite anchor parts 120 of the V-shaped tie hoops 100 while surrounding the anchor parts 120, and the opposite arc-shaped support parts 310 are strongly attached by the elasticity of the fixing clip 300 by making the interval between the opposite arc-shaped support part 310 the same as or narrower than the interval between the anchor parts 120 at the coupling portions.

Further, the V-shaped tie hoop is inserted by forming the insertion guide part 320 at an upper portion of the arc-shaped support part 310 in an opened form, and the interval between the insertion guide parts 320 are formed to have a width that is smaller than the interval between the arc-shaped support parts 310 to prevent deviation of the insertion guide parts 320 when the insertion guide parts 320 are seated on the arc-shaped support parts 310. Further, a coupling guide can be stably made by forming a curved portion at a lower end portion of the insertion guide part 320 to be curved outwards.

The elastic operation part 330 is a configuration that is formed between the opposite arc-shaped support parts 310 and is capable of accommodating a width, by which the interval between the arc-shaped support parts 310 may be changed, and the restoring tensions of the arc-shaped support part 310 can maintain a strong coupling force while facilitating coupling by allowing elastic deformation of the arc-shaped support parts 310 as the elastic operation parts 330 are present.

In addition, because the elastic operation part 330 also functions as a handle, the elastic operation part 330 may be conveniently coupled while being pressed by a hand when the fixing clip 300 is coupled while being pressed from the upper side of the V-shaped tie hoop 100. The elastic operation part 330 may be realized while being bent by 90 degrees to further facilitate a pressing operation.

Figure 11:
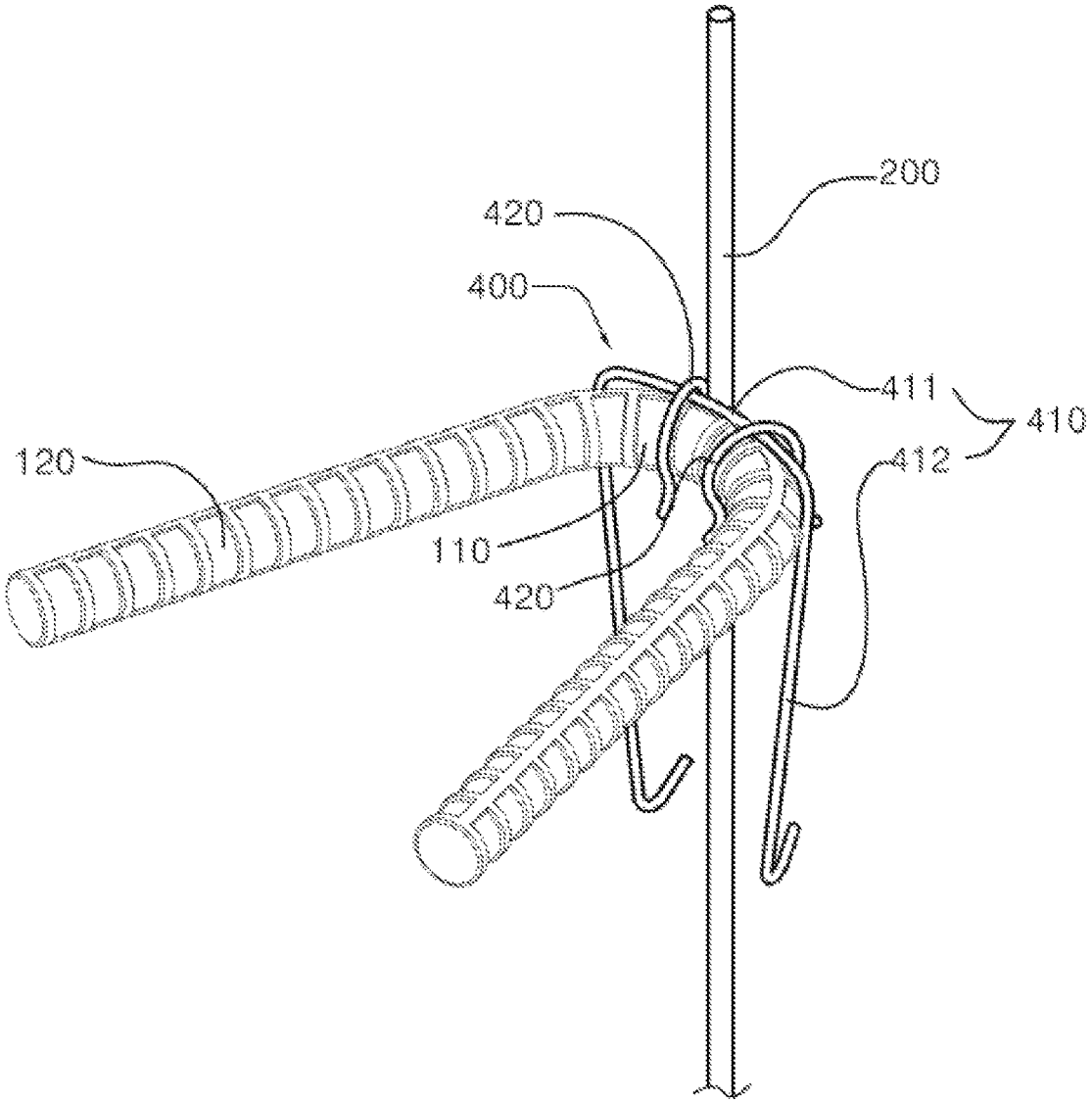
FIGS. 11 and 12 is a view illustrating an embodiment in which a rotation preventing member is further coupled to the V-shaped tie hoop according to the present invention.
Figure 12:
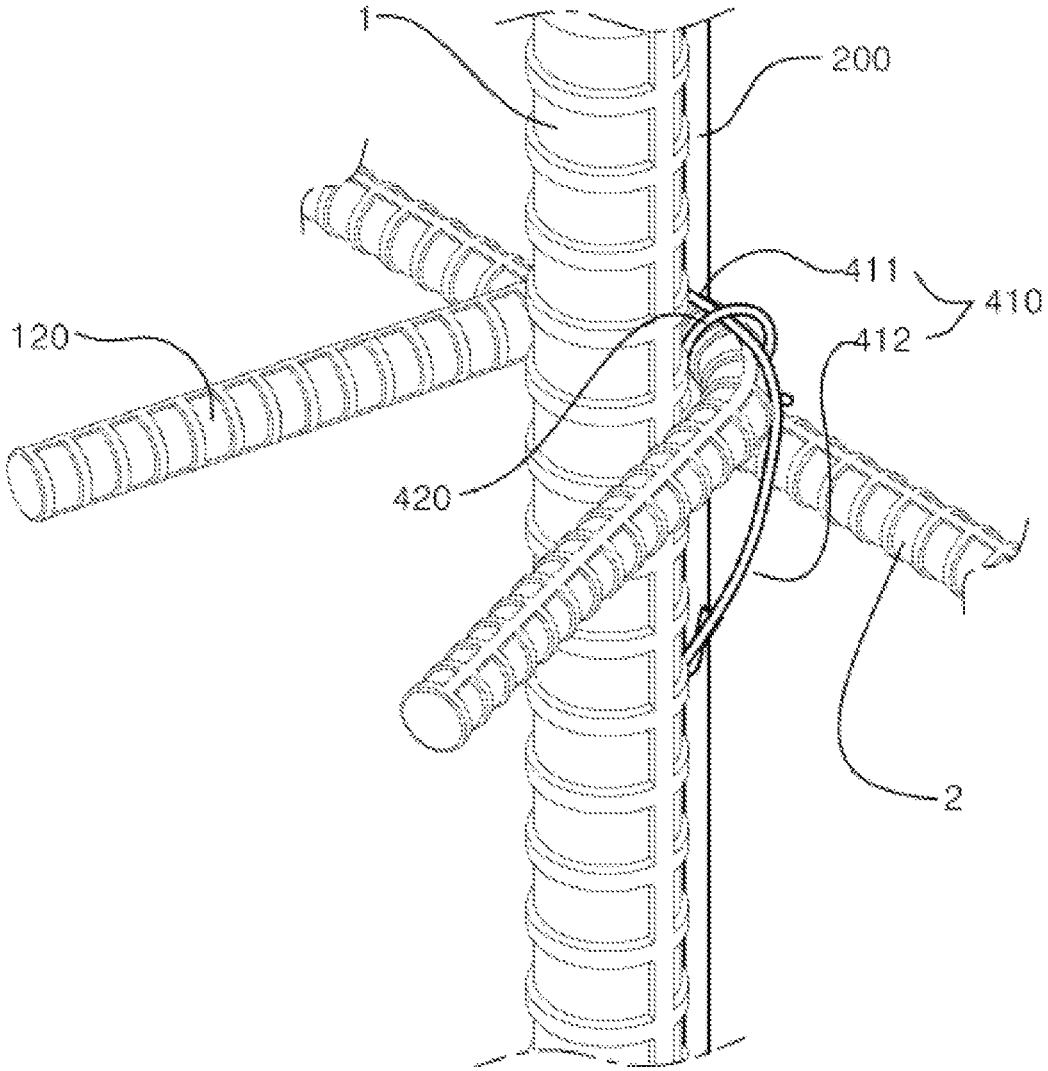

Further, the present invention, as illustrated in FIGS. 11 to 12, a rotation preventing member 400 may be coupled to the V-shaped time hoop 100 to prevent the V-shaped tie hoop 100 from rotating leftwards and rightwards. The rotation preventing member 400 includes a rotation support 410 including a horizontal support part 411 extending horizontally over the V-shaped tie hoop 100 and a leg part 412 bent downwardly from opposite ends of the horizontal support part 411, and a C-shaped fixing clip 420 that is coupled to the V-shaped tie hoop 100 while the rotation support part 410 extends to fix the rotation support 410.

Although the embodiments have been described to described the present invention, various modifications may be made without departing from the technical spirit of the present invention.

What is claimed is:

1. A V-shaped tie hoop assembly that is applied to a vertical main reinforcement and a hoop reinforcement that supports an outer circumference of the main reinforcement, the V-shaped tie hoop assembly comprising:

a plurality of V-shaped tie hoops, each of which has a bending part at a center thereof and anchor parts extending to opposite sides of the bending part, and disposed at different heights at an interval; and a vertical support bar connecting all of the V-shaped tie hoops to integrally couple the V-shaped tie hoops, wherein the support bar is coupled to outsides of the bending parts of the V-shaped tie hoops, and wherein hoop parts having a pair of hoops of an inverse U shape are integrally fixed on opposite sides of the support bar, and the hoop parts support an inside and an outside of the hoop reinforcement.

2. The V-shaped tie hoop assembly of claim 1, further comprising:

fixing clips coupled to the V-shaped tie hoops to increase coupling forces with the main reinforcement located inside the bending parts.

3. The V-shaped tie hoop assembly of claim 2, wherein each of the fixing clips comprises:

an arc-shaped support part bent in an arc shape such that the anchor parts of the V-shaped tie hoops are seated on opposite sides of an inner side thereof;

an insertion guide part formed at a lower portion of the arc-shaped support part to be widened such that the V-shaped tie hoop is inserted, and having a width that is smaller than an interval of the arc-shaped support parts; and an elastic operation part formed at a center of an upper portion of the arc-shaped support part to be bent so as to be elastically deformed to opposite sides.

* * * * *